United States Patent [19]

Heneveld

[11] Patent Number: 4,987,633

[45] Date of Patent: Jan. 29, 1991

[54] BRISTLE HAIR BRUSH RETRACTABLE BY COLLAPSING HANDLE

[76] Inventor: William R. Heneveld, 9946 Elmada, Dallas, Tex. 75220

[21] Appl. No.: 425,337

[22] Filed: Oct. 23, 1989

[51] Int. Cl.[5] ..... A46B 9/10

[52] U.S. Cl. ..... 15/185; 15/169; 132/121

[58] Field of Search ..... 15/169, 184, 185, 203; 132/121, 123, 129, 151

[56] References Cited

U.S. PATENT DOCUMENTS

| | | | |
|---|---|---|---|
| 330,270 | 11/1885 | Stehlin . | |
| 450,042 | 4/1891 | Schulz . | |
| 560,662 | 5/1896 | Tupper . | |
| 696,798 | 4/1902 | Chambers . | |
| 818,696 | 4/1906 | Kulenkampff . | |
| 1,141,662 | 6/1915 | Bridges . | |
| 1,142,356 | 6/1915 | Nellany | 15/185 |
| 1,272,907 | 7/1918 | Bridges . | |
| 1,280,180 | 10/1918 | Deason | 132/121 |
| 1,302,247 | 7/1919 | Troy . | |
| 1,353,597 | 11/1920 | Tobias . | |
| 1,387,063 | 8/1921 | Matsugaki . | |
| 1,388,955 | 8/1921 | Kozlowsky et al. . | |
| 1,592,510 | 7/1926 | Toepperwein . | |
| 1,627,200 | 11/1926 | Pickar . | |
| 1,631,011 | 5/1927 | Connor . | |
| 1,696,727 | 12/1928 | Olmazu . | |
| 1,889,182 | 11/1932 | Rosenberg . | |
| 1,927,093 | 9/1933 | Ingwersen et al. | 15/184 |
| 1,949,671 | 3/1934 | Zerilli | 15/184 |
| 2,159,432 | 5/1939 | Enns | 15/185 |
| 2,427,559 | 9/1947 | Johnson | 15/184 |
| 2,604,649 | 7/1952 | Stephenson et al. | 15/203 |
| 2,946,075 | 7/1960 | Slaughter, Jr. | 15/184 |
| 3,055,033 | 9/1962 | Peilet et al. | 15/184 |
| 3,065,482 | 11/1962 | Bottler | 15/203 |
| 4,023,230 | 5/1977 | Friedman et al. | 15/185 |
| 4,412,365 | 11/1983 | Schmitt | 15/169 |
| 4,574,416 | 3/1986 | Stewart et al. | 15/169 |

FOREIGN PATENT DOCUMENTS

| | | | |
|---|---|---|---|
| 793548 | 11/1935 | France | 15/203 |
| 558157 | 1/1975 | Switzerland | 15/203 |

*Primary Examiner*—Philip R. Coe
*Assistant Examiner*—Mark Spisich
*Attorney, Agent, or Firm*—Price, Heneveld, Cooper, DeWitt & Litton

[57] ABSTRACT

A compact portable brush having a handle which is collapsed to reduce the size of the brush when carried whereby the handle extending from the housing for the brush bristles is interconnected with the bristle support means to cause the bristles to be retracted into the housing when the handle is collapsed in the compact, carry position. In the preferred embodiment, the bristles are supported on a bristle support member which when actuated from retracted to extended position, or vice versa, is moved along a path inclined to the longitudinal axis of the housing whereby the bristles in the retracted position are caused to be arranged at an angle inside the housing, such angle being accommodated by a living hinge connection between the bristle support and the bristles.

29 Claims, 3 Drawing Sheets

FIG. 1
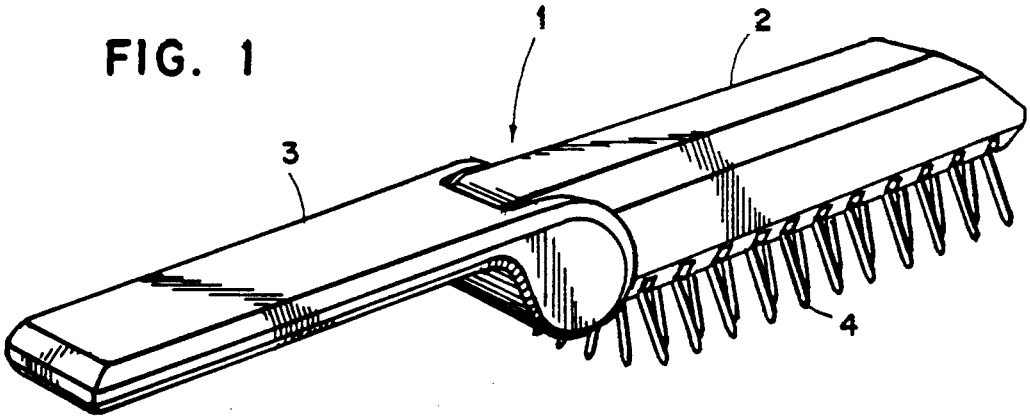
FIG. 2
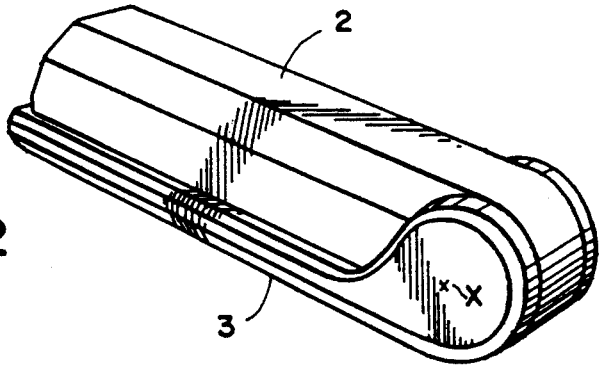
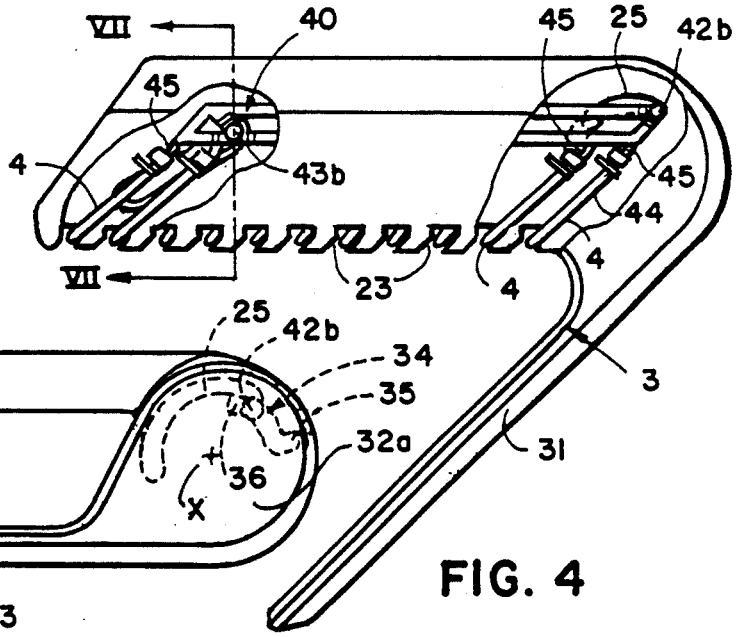
FIG. 4
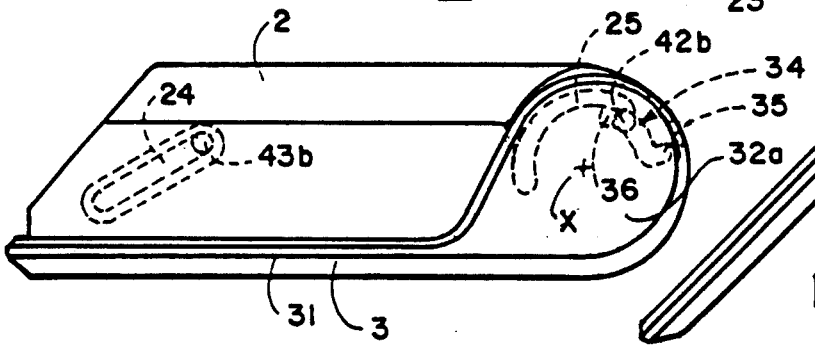
FIG. 5

BRISTLE HAIR BRUSH RETRACTABLE BY COLLAPSING HANDLE

BACKGROUND OF THE INVENTION

The present invention relates to a brush having bristles wherein the bristles are retracted into a housing by means of a collapsing handle Such handle has a multipurpose of providing a handle that can be comfortably gripped while brushing the hair or other object and which controls the extension and retraction of the bristles into a housing. When retracted the handle is collapsed providing a compact brush that is easier to carry and store because of its minimal size, there are no snagging bristles exposed and no hair is shed during carrying or storage.

The prior art discloses a number of retractable brushes but to my knowledge none of them have been entirely satisfactory because they did not have a handle or when it did have a handle, the handle increased the size of the brush and made it bulky to carry and store Further, many of the prior art retractable brushes do not provide a self-cleaning feature Further, others have provided for retracting the bristles but when retracted the bristles are exposed so that when the user reaches into the carrying case such as a women's purse the bristles stab the fingers. Also, exposed bristles damage other things carried in the same container.

Other retractable brushes are extremely complicated and made up of a number of moving parts that are expensive to manufacture and assemble. Thus, such retractable brushes have found substantially no commercial success or very little commercial success because of the cost involved in the manufacture of the parts and the assembly thereof.

SUMMARY OF THE INVENTION

According to the present invention, a simple, and thus, less costly, retractable brush is disclosed that is made up of a minimum number of parts that are easily assembled. This cost effective design provides for a conveniently portable brush which has all the accepted features of a conventional hair brush such as a comfortable handle that can be folded onto the housing of the brush and while being folded, the handle causes the bristles to be withdrawn or retracted into the brush housing. The handle of my brush is interconnected with the support for the bristles so that when the handle is folded, it moves the bristle support so that all of the bristles are retracted prior to the handle being completely folded over the bristles. At this stage, the clearance between the handle and the housing allows for hair to be wiped off the housing that has been removed from the retracting bristles. The handle is then independently movable of the bristle support so that it can be folded completely over the bristles.

In accordance with my invention, a unique bristle component is provided along with a unique mechanism for causing the handle to move the bristle support in a direction that is inclined to the longitudinal axes of the brush. This action is permitted by providing groove means within the brush housing which directs the movement of the bristle support along a path inclined to the longitudinal axes of the brush.

The bristle component is unique in that it comprises a plurality of rows of bristles extending laterally of the brush housing. Each row of bristles comprises a number of bristles and the rows are spaced longitudinally of the brush housing which has a plurality of slots with each row aligned with one of the slots. Each bristle is supported on a flexible plate, one of which is provided for each row of bristles. The connection of the plate to the bristle support is by a living hinge which permits the bristles to tip as the bristle support moves along the inclined path. The plate that supports the bristles is flexible so that when the bristles and handle are completely extended, each of the plates are made to conform with an arcuate surface within the brush housing causing the bristles to flare outwardly.

In accordance with this invention, the bristle component includes a support member, the flexible bristle plates connected to the support member by living hinges, bristles and pin means for guiding the bristle support member all of which are formed of one molded piece. The other parts of the brush are two clam-like shaped halves forming the housing, and the handle. All of these parts making up my brush are plastic molded parts providing a very cost effective design while still providing all the accepted features of a conventional hair brush along with the added features of providing a small and compact unit in which the bristles are fully enclosed and protected when being carried or stored as well as providing a self-cleaning unit.

All of the above structure and advantages of my invention will become obvious upon reading the following description in conjunction with the appended drawings.

BRIEF DESCRIPTION OF THE DRAWINGS

FIG. 1 is a side, elevational, perspective view of my brush with the handle completely extended;

FIG. 2 is a side, elevational, perspective view of my brush with the handle completely collapsed or folded and the bristles retracted;

FIG. 4 is a side, elevational view like FIG. 3 with the handle partially folded to a position wherein the bristles have been retracted by the handle;

FIG. 5 is a side, elevational view of my brush with the handle completely folded or collapsed and also disclosing by hidden lines the guide grooves provided for providing the bristle support member;

Figure 3:
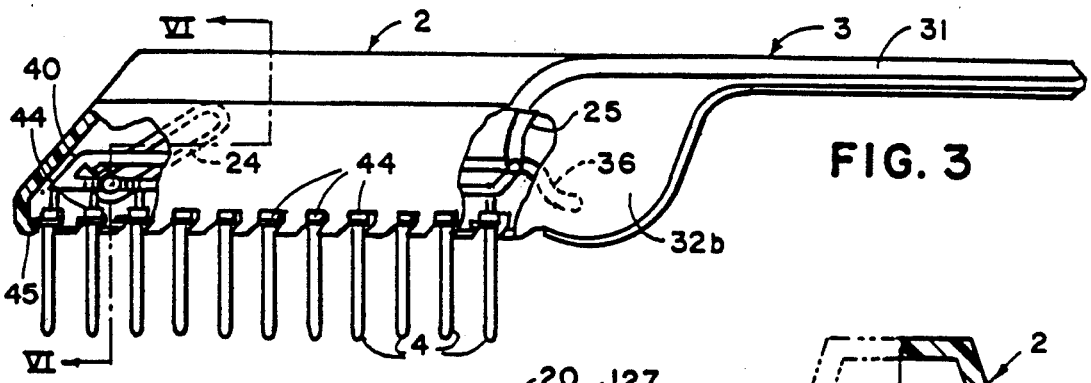
FIG. 3 is a side, elevational view of my brush with the handle and bristles completely extended and cut away to show some of the operative mechanism.
Figure 6:
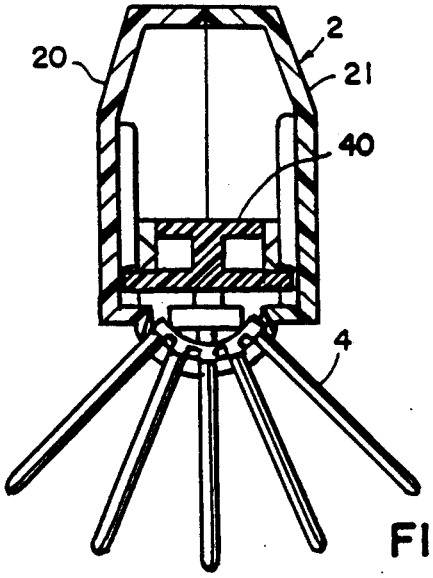
FIG. 6 is a cross-sectional, enlarged view taken along the plane VI—VI of FIG. 3.
Figure 7:
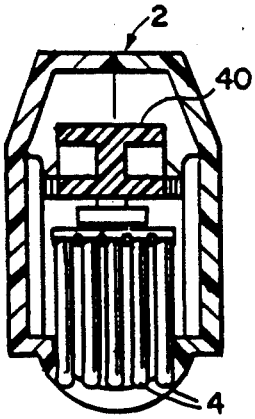
FIG. 7 is a cross-sectional, enlarged view taken along the plane VII—VII of FIG. 4.
Figure 10:
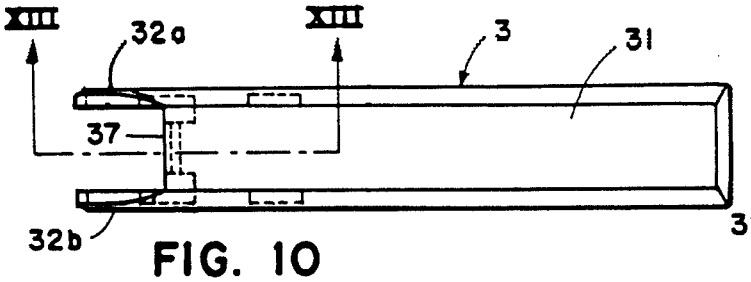
FIG. 10 is a plan view of the handle separate and apart from the other parts of the brush.
Figure 12:
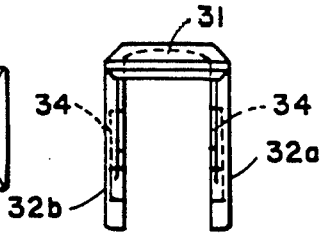
FIG. 12 is an end, elevational view from the end opposite the handle ears.
Figure 11:
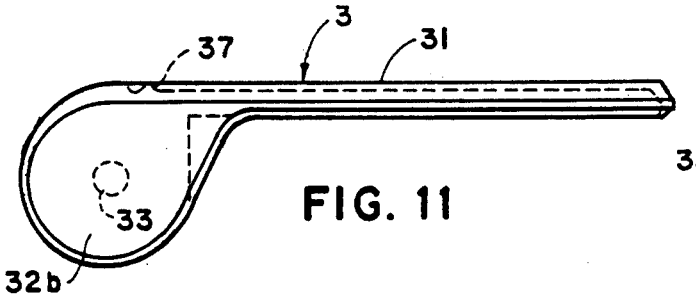
FIG. 11 is a side, elevational view of the handle separate and apart from the other parts of the brush.
Figure 13:
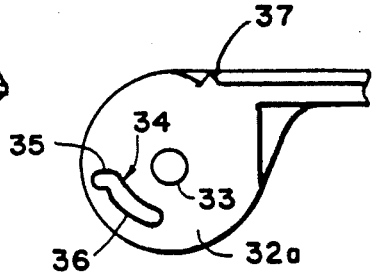
FIG. 13 is a cross-sectional view taken along the plane XIII—XIII of FIG. 10.
Figure 14:
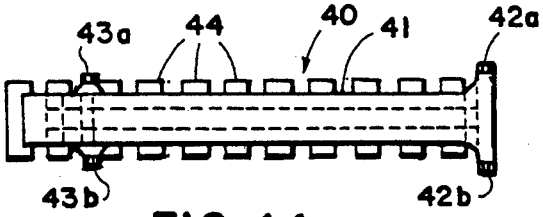
FIG. 14 is a plan view of the bristle component separate and apart from any of the other parts of the brush.
Figure 16:
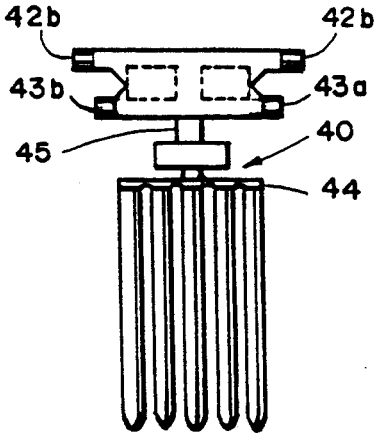
FIG. 16 is an end, elevational, enlarged view of the bristle component of FIGS. 14 and 15.

Referring to the drawings, the reference numeral 1 designates the brush having a housing 2 and a handle 3. Bristles 4 extend from housing 2 when the handle 3 is extended (FIGS. 1, 3, and 6). When the handle 3 is collapsed or folded (FIGS. 2, 5, and 7), the bristles 4 are retracted into the housing 2. This retraction of the bristles is accomplished by a unique interconnection between the handle 3 and bristle support member as will be described hereinafter.

Figure 8:
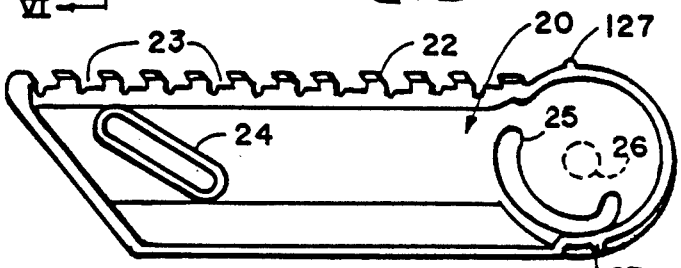
FIG. 8 is a side, elevational view of one of the half parts of the brush housing.
Figure 9A:
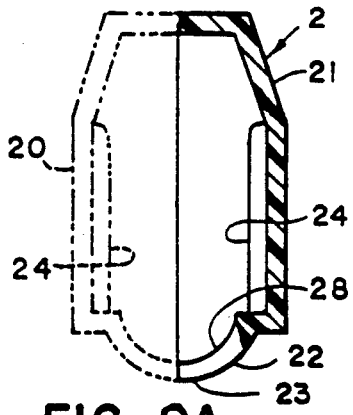
FIG. 9A is a cross-sectional, enlarged view taken along the plane A—A of FIG. 9.
Figure 9:
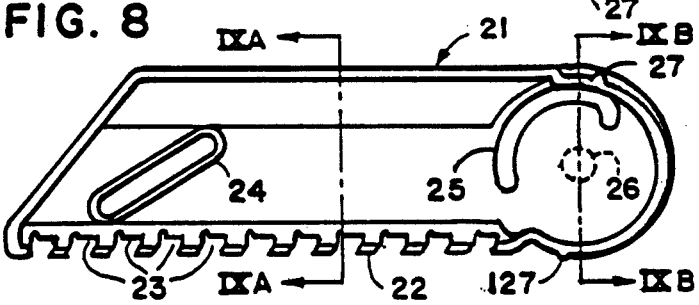
FIG. 9 is a side, elevational view of the other half part which forms the brush housing.
Figure 9B:
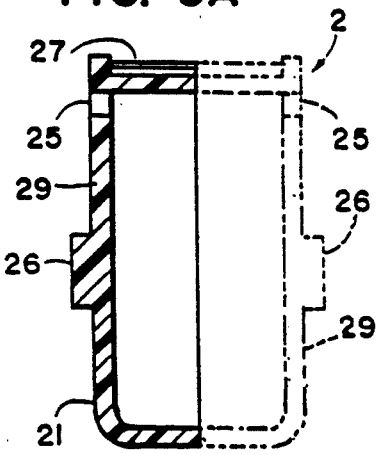
FIG. 9B is a cross-sectional, enlarged view taken along the plane B—B of FIG. 9.

Housing 2 is made up of two half parts 20 and 21 which are mirror images of each other as disclosed in FIGS. 8 and 9. Each of these parts are elongated and have a clam shell shape so that when they are mated together as disclosed in FIGS. 9A and 9B, a housing is formed in which is located the bristle component 40 as disclosed in FIGS. 3, 4, 6 and 7. Each of the half parts 20 and 21 have a arcuate bottom 22 as viewed in FIGS. 6, 7 and 9A and in which a plurality of laterally extending slots 23 are formed for receiving a row of bristles The inside surface of each of the parts 20 and 21 include a guide channel or track 24 formed on the inner wall of the part for guiding the bristle component 40. Each part 20 and 21 also includes a guide slot 25 also provided for the purpose of guiding the bristle component 40. A cylindrical protrusion 26 extends from the side of each part 20 and 21. The protrusion 26 provides a pivot for the handle 3. A boss 27 is provided on each of the parts for cooperating with a detent 37 on the handle to lock the handle 3 in extended position. Also, bosses 127 of each half are provided for cooperating with detent 37 on the handle to lock the handle 3 in the folded position. Each of the parts 20 and 21 are molded of a suitable plastic material.

Figure 15:
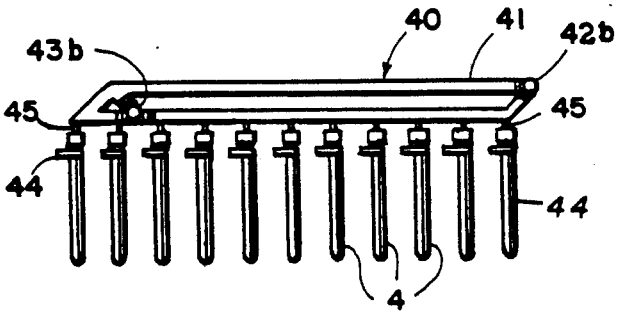
FIG. 15 is a side, elevational view of the bristle component of FIG. 14.
Figure 17:
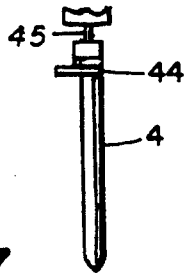
FIG. 17 is an enlarged view of one of the bristles connected to one of the support plates which in turn is connected to the support member by a living hinge.

The bristle component 40 is mounted inside the housing 2 for movement along a path which is inclined to the longitudinal axis of the housing 2. Bristle component 40 includes the bristle support member 41 having at one end the guide pins 42*a* and 42*b* and at the other end the guide pins 43*a* and 43*b*. Support member 41 supports the bristles 4 depending downwardly therefrom. The bristles are arranged in rows (FIGS. 3, 4, and 15), each row being supported by a flexible plate 44 which in turn is supported by the support member 41 by means of a living hinge 45. Living hinge 45 has a thin cross section as viewed in FIGS. 15 and 17 permitting each row to assume an angled position as the bristles are retracted into the narrow brush housing 2 (FIG. 4). When the bristles 4 are extended, the flexible plates 44 abut the inner rounded surfaces 28 of the bottom wall 22 and are forced by the handle 3 to conform to the arcuate shape of the surface 28 causing the bristles 4 to spread outwardly (FIG. 6). The entire bristle component 40 is molded in one piece from a plastic material, such as polypropylene, allowing prolonged use as a living hinge.

The construction of the handle 3 is best disclosed in FIGS. 10, 11, 12 and 13. Handle 3 includes an elongated arm or cover portion 31 having a pair of spaced ears 32*a* and 32*b* spaced one from the other a distance corresponding to the distance between the outside surfaces of the walls 29 (FIG. 9B) at one end of the housing 2. Ears 32*a* and 32*b* each have a cylindrical blind opening 33 of a diameter slightly greater than the protrusions 26 of the housing 2 and aligned with each other to receive protrusions 26 so that when mounted on the housing, arm 31 of handle 3 is mounted for rotation about the axes of openings 33 and protrusions 26. The ears 32*a* and 32*b* also include a groove 34 (FIG. 13) having a configuration as disclosed for the purpose of receiving the pins 42*a* and 42*b* of bristle support 41 for actuating the bristle component 40 to withdraw the bristles inside the housing 2 and extend the bristles for brushing. As will be explained hereinafter, the portions 35 of the grooves 34 are provided to engage pins 42*a* and 42*b* to actuate support 41. The remaining portion 36 is provided to permit the arm to be folded independent of the bristle component movement from the position of FIG. 4 to the completely folded and covered position of FIG. 5, the reason for which will be explained hereinafter.

The inside surface of the arm or cover portion 31 is shaped to substantially conform with the outer surface of the slotted bottom of housing 2. The handle is molded of a suitable plastic material.

ASSEMBLY

The assembly of the four parts of my brush is very simple. The bristle component 40 is positioned in one housing half 20 or 21, then the other housing half 21 or 20 is placed over the bristle section and mated to the other housing half. During this assembly, pins 43*a* and 43*b* are positioned in guide tracks 24 and pins 42*a* and 42*b* are positioned in slots 25. Mated together, the housing halves 20 and 21 are secured by sonic welding or another suitable means. When so assembled, the pins 42*a* and 42*b* extend through the slots 2$ a sufficient distance to be received within the grooves 34 of the handle 3. The ears 32*a* and 32*b* are mounted over the end of the housing which contains the slots 25 and protrusions 26. This is accomplished by slightly spreading the semi-rigid ears so that the protrusions 26 are received in the openings 33 and the pins 42*a* and 42*b* are received within the grooves 34. Once the protusion 26 and the pins 42*a* and 42*b* are aligned with their respective openings and slots, the ears will snap back in place over the protrusions 26 and pins 42*a* and 42*b* so as to be held firmly on the end of the housing 2. In this position, the arm 31 of handle 3 is capable of moving the bristle support 41 so as to extend or retract the bristles 4.

OPERATION

The operation of my brush is simple. Extending the handle to a position as disclosed in FIG. 1 also extends the bristles 4, while folding the handle to a closed position as shown in FIG. 2 causes automatic retraction of the bristles 4. These respective actions are accomplished by the structure as follows.

Starting in the position as disclosed in FIG. 1 wherein the handle and the bristles are extended ready for brushing, the handle 3 is held in that extended position by the bosses 27 of housing 2 being captured within the detent 37 of the handle 3. Also, helping to hold the bristles and handle in the extended position are pins 42*a* and 42*b* resting in the end of slots 25, just past the neutral position opposite the majority of slots 25. A pivotable force exerted on the handle overcomes the holding force of the boss 27 in the detent 37. Further pivoting of the arm 31 causes pins 42*a* and 42*b* to cross the neutral point and travel in slots 25 allowing the bristle support 41 to be moved along a path defined by the inclination of the track or groove 24 and the arc defined by slot 25. This is accomplished by the end portions 35 of the slot 34 applying a force to the pins 42*a* and 42*b*, the end portions 35 being matched with slots 25 of the housing so that the pins 42*a* and 42*b* will not follow the slot portions 36 of the slot 34 until the bristles are retracted to the position as disclosed in FIG. 4. When the bristle support 41 reaches the position of FIG. 4, the bristles are fully retracted and the clearance existing between the arm 31 and the housing portion 22 allows any hair removed from the retracting bristles to be wiped off the housing portion 22. Also, in FIG. 4, pins 42*a* and 42*b* reach the end of slots 25 and are pulled inward at a slightly reduced radius than the major parts of slots 25. At this radius, pins 42*a* and 42*b* are allowed to ride in portions 36 of grooves 34 and the arm 31 can be completely closed or folded during which movement the bristle component 40 does not move and the bristles 4 remain fully retracted. When the handle 3 is in the fully folded position, the bosses 127 of the housing 2 are received in the detent 37 of the handle 3 which locks the handle in the folded position. As previously disclosed, as the bristles are retracted into the housing 2, each row of bristles 4 are independently permitted to assume a tipped position by the flex of the living hinge 45.

When operating the brush from the folded position of FIGS. 2 and 5, the arm 31 of handle 3 is pivoted about the axis X causing the grooves 34 in the ears of the handle 3 to move over the pins 42*a* and 42*b* until the grooved portion 35 reaches the pins at which time pins 42*a* and 42*b* are pushed to a slightly greater radial distance from the axis X and by further pivoting of the arm 31, the pins 42*a* and 42*b* ride in the grooves 25 and the pins 43*a* and 43*b* ride within the tracks 24. This causes the bristle support 41 to move downwardly along an inclined path as viewed in FIG. 4. Thus, the pins 43*a* and 43*b* ride in the tracks 24 and pins 42*a* and 42*b* ride in the slots 25. As the bristle component 40 moves to a position in which the bristles are fully extended, the flexible plates 44 engage the rounded inner surface 28 of the bottom 22 of the housing 2 and are made to conform to the rounded surface 28 causing the bristles to be spread as disclosed in FIG. 6. When the arm 31 is in fully extended position, the boss 27 of housing 2 is received in the detent 37 of the handle 3 and pins 42*a* and 42*b* rest in the end of slots 25 which locks the handle and bristles in the extended position and the brush is ready for use.

It is evident from the above description that I have provided a cost-effective design for a portable brush which has all the accepted features of a conventional brush. It has a comfortable handle with acceptable bristles that are flared out and thus arranged as are most conventional hair brushes I have provided a portable brush that is compact and easy to carry and store. It does not have any snagging bristles exposed when carried or stored so that stabbing of fingers and damage to other things is eliminated. It is self-cleaning and thus will not shed hair when carried or stored Further, the operation is simple. The handle completely covers the slots provided for the bristles and also the bristles.

Having described my invention, it should, however, be understood that other forms, embodiments and applications of the invention may occur to those skilled in the art and it is intended by the appended claims to cover all such modifications coming within the spirit of the invention.

The embodiments of the invention in which an exclusive property or privilege is claimed are defined as follows:

1. A brush having retractable bristles, said brush including an elongated housing having a first wall with a plurality of openings located across said first wall through which the bristles extend from said first wall when in extended operable position and are retracted when in stored position;

bristle support means interior of said housing;

a handle associated with said housing and adapted to be grasped for supporting the brush during the brushing operation;

said handle being pivotally mounted on said housing;

interconnected means interconnecting said handle with said bristle support means for actuating said bristle support means when the handle is pivoted to cause said bristles to be extended through said openings and from said wall when said handle is pivoted to an extended position from said housing, in which extended position the handle serves the function of a support handle for the brush;

said interconnection means being provided to move the bristle support means in the housing in a direction both away from or toward said wall and in a direction longitudinally of said elongated housing in addition to directions away and toward said wall, said movement of said bristle support means in the direction longitudinally of said housing being simultaneous with the movement away from or toward said wall whereby the combined movements toward or away from said wall is inclined to the longitudinal axes of said housing;

said handle being pivotable to a folded position over said wall and said openings in which folded position said bristle support means is actuated by said handle and interconnection means to cause said bristles to be retracted into said housing;

said handle being configured to provide a cover for covering all of the said openings.

2. The brush of claim 1 in which spaced parallel sidewalls extend from said first wall and guide means is provided on the interior surfaces of said sidewalls for guiding the combined movement of said bristle support means along a path inclined to the longitudinal axis of said housing.

3. The brush of claim 2 in which the guide means includes guide pins on one of said bristle support means and sidewalls and guide grooves in the other of said bristle support means and sidewalls, said pins being received in said guide grooves.

4. The brush of claim 3 in which the guide grooves each include parallel spaced walls inclined to the longitudinal axis of said housing and generally in the same direction as said inclined movement of said bristle support whereby the bristles are caused to be moved by said walls to an inclined position relative to the longitudinal axis of the housing when retracted into said housing.

5. The brush of claim 4 in which hinge means connects the bristles to said bristle support means permitting the bristles to assume the said inclined position.

6. The brush of claim 5 in which the hinge means is a living hinge.

7. The brush of claim 1 in which said interconnection means includes means whereby pivoting of said handle from said extended position to a position short of said folded position causes movement of said bristle support means to a position wherein said bristles are retracted into said housing in stored position; and means for subsequently permitting pivoting of said handle independent of the movement of said bristle support means to said folded position.

8. A brush having retractable bristles, said brush including an elongated housing having a first wall with a plurality of openings located across said first wall through which the bristles extend from said first wall when in extended operable position and are retracted when in stored position;

bristle support means interior of said housing;

a handle associated with said housing and adapted to be grasped for supporting the brush during the brushing operation;

said handle being pivotally mounted on said housing;

interconnected means interconnecting said handle with said bristle support means for actuating said bristle support means when the handle is pivoted to cause said bristles to be extended through said openings and from said wall when said handle is pivoted to an extended position from said housing, in which extended position the handle serves the function of a support handle for the brush;

said handle being pivotable to a folded position over said wall and said openings in which folded position said bristle support means is actuated by said handle and interconnection means to cause said bristles to be retracted into said housing;

said handle being configured to provide a cover for covering all of the said openings; and said retractable bristles being arranged in rows and said openings are slots extending laterally across said first wall, each row extending through one of said slots; said bristles being mounted on a flexible plate; said first wall having an arcuate inner surface whereby when said bristles are extended, said flexible plate flexes causing said bristles to flare radially outwardly.

9. A brush having retractable bristles, said brush including an elongated housing having a first wall with a plurality of openings located across said first wall through which the bristles extend from said first wall when in extended operable position and are retracted when in stored position;

bristle support means interior of said housing;

a handle associated with said housing and adapted to be grasped for supporting the brush during the brushing operation;

said handle being pivotally mounted on said housing;

interconnected means interconnecting said handle with said bristle support means for actuating said bristle support means when the handle is pivoted to cause said bristles to be extended through said openings and from said wall when said handle is pivoted to an extended position from said housing, in which extended position the handle serves the function of a support handle for the brush;

said handle being pivotable to a folded position over said wall and said openings in which folded position said bristle support means is actuated by said handle and interconnection means to cause said bristles to be retracted into said housing;

said handle being configured to provide a cover for covering all of the said openings; and said bristle support means being an elongated support member having a plurality of rows of bristles resiliently attached at longitudinal spaced positions along said support member, said spacing corresponding to the spacing of said openings; each row of bristles comprising a plate to which said bristles of each row are attached at spaced intervals along said plate; each of said plates being attached to said support member by a living hinge.

10. The brush of claim 9 in which the interconnection means move the bristle support member in a direction both away from or toward said wall and longitudinally of said housing upon pivoting of said handle whereby the combined movement of said bristle support is along a path inclined to the longitudinal axes of said housing; said living hinge of each of said bristles permitting the bristles to assume an inclined position relative to the longitudinal axes of said housing.

11. The brush of claim 10 in which the openings each include parallel spaced walls inclined to the longitudinal axis of said housing and generally in the same direction as said inclined movement of said bristle support whereby the bristles are caused to be moved by said walls to an inclined position relative to the longitudinal axis of the housing when retracted into said housing.

12. The brush of claim 10 in which spaced parallel sidewalls extend from said first wall and guide means is provided on the interior surfaces of said sidewalls for guiding the combined movement of said bristle support means along a path inclined to the longitudinal axis of said housing.

13. The brush of claim 12 in which the guide means includes guide pins on one of said bristle support means and sidewalls and guide slots in the other of said bristle support means and sidewalls, said pins being received in said guide slots.

14. The brush of claim 13 in which the guide pins extend from said bristle support and are integrally molded therewith.

15. The brush of claim 9 in which the bristle support, bristles and living hinge are integrally molded in one piece.

16. The brush of claim 14 in which the bristle support, bristle, living hinge and pins are integrally molded in one piece.

17. A brush having retractable bristles, said brush including an elongated housing having a first wall with a plurality of openings located across said first wall through which the bristles extend from said first wall when in extended operable position and are retracted when in stored position;

bristle support means interior of said housing;

a handle associated with said housing and adapted to be grasped for supporting the brush during the brushing operation;

said handle being pivotally mounted on said housing;

interconnected means interconnecting said handle with said bristle support means for actuating said bristle support means when the handle is pivoted to cause said bristles to be extended through said openings and from said wall when said handle is pivoted to an extended position from said housing, in which extended position the handle serves the function of a support handle for the brush;

said handle being pivotable to a folded position over said wall and said openings in which folded position said bristle support means is actuated by said handle and interconnection means to cause said bristles to be retracted into said housing;

said handle being configured to provide a cover for covering all of the said openings;

said interconnection means being provided to move the bristle support means in the housing in a direction both away from or toward said sall; and spaced parallel sidewalls extending from said first wall, said sidewall having grooves; interconnection means including a pin means on at least one end of said bristle support means and extending into said grooves to provide means for guiding the movement of said bristle support; said handle being pivoted on the end of said housing adjacent the said one end of said bristle support means and connected to said pin means whereby pivoting of said handle moves the bristle support means along a path determined by said pin means riding in said grooves.

18. The brush of claim 17 in which the connection between said handle and said pin means includes at least one groove in said handle receiving said pin means; said groove being configured to cause, in response to rotation of said handle from extended position to a position short of folded position, the movement of said bristle support means along said path to a position wherein said bristles are retracted; said groove subsequently permitting pivoting of said handle to said folded position.

19. In a brush having retractable bristles, a bristle component comprising:

an elongated support member;

a plurality of support plates extending laterally of said support member and spaced one from the other along the length of said support member;

a plurality of bristles connected to said support plates and spaced one from the other along the length of said support plates; and a living hinge connecting said support plate to said support member.

20. The brush of claim 19 in which said support member, support plates, bristles and living hinge are molded in one piece.

21. The brush of claim 19 in which guide pins are provided at each end of said support member and said brush includes an elongated housing having an inner surface with guide means cooperating with said guide pins to guide said support member along a predetermined path.

22. The brush of claim 21 comprising a handle mounted on one end of said elongated housing and means for operatively connecting it to said support member for moving said support member causing said bristles to be extended and retracted within said housing.

23. The brush of claim 22 in which the operative connection between said handle and support member is a connection between said handle and pins located at the end of said support member adjacent to the housing end on which said handle is mounted.

24. The brush of claim 23 in which said handle includes a groove means receiving said pins, said groove means being configured to cause said handle as it is pivoted to a predetermined position to move said support member until said bristles are retracted after which the handle is pivotable independent of the movement of said support members to a position over said retracted bristles.

25. A brush having retractable bristles, said brush including an elongated housing having a first wall with a plurality of openings located across said first wall through which the bristles extend from said first wall when in extended operable position and are retracted when in stored position;

bristle support means interior of said housing;

a handle associated with said housing and adapted when in an extended position to be grasped for supporting the brush during the brushing operation;

said handle being movably mounted on said housing from a collapsed position to said extended position;

interconnected means interconnecting said handle with said bristle support means for actuating said bristle support means when the handle is moved to cause said bristles to be extended through said openings and from said wall when said handle is moved to an extended position from said housing;

said handle being movable to a collapsed position in which collapsed position said bristle support means is actuated by said handle and interconnection means to cause said bristles to be retracted into said housing; and said interconnected means includes track means provided on the interior surfaces of said housing and pin means on said bristle support means for riding in said track means, said track means guiding the movement of said bristle support at means along a path inclined to the longitudinal axis of said housing as said bristles are extended and retracted by the extension and collapsing of said handle.

26. The brush of claim 25 in which the guide grooves each include parallel spaced walls inclined to the longitudinal axis of said housing and generally in the same direction as said inclined movement of said bristle support whereby the bristles are caused to be moved by said walls to an inclined position relative to the longitudinal axis of the housing when retracted into said housing.

27. The brush of claim 25 in which the retractable bristles are arranged in rows, each row extending through one of said slots; said bristles being mounted on a flexible plate; said first wall having an arcuate inner surface whereby when said bristles are extended, said flexible plate flexes causing said bristles to flare radially outwardly.

28. The brush of claim 27 in which the bristle support means is an elongated support member having a plurality of rows of bristles resiliently attached at longitudinal spaced positions along said support member, said spacing corresponding to the spacing of said slots; each row of bristles comprising a plate to which said bristles of each row are attached at spaced intervals along said plate; each of said plates being attached to said support member by a living hinge.

29. A brush having retractable bristles, said brush including an elongated housing having a first wall with a plurality of openings located across said first wall through which the bristles extend from said first wall when in extended operable position and are retracted when in stored position;

bristle support means interior of said housing;

a handle associated with said housing and adapted when in an extended position to be grasped for supporting the brush during the brushing operation;

said handle being movably mounted on said housing from a collapsed position to said extended position;

interconnected means interconnecting said handle with said bristle support means for actuating said bristle support means when the handle is moved to cause said bristles to be extended through said openings and from said wall when said handle is moved to an extended position from said housing;

said handle being movable to a collapsed position in which collapsed position said bristle support means is actuated by said handle and interconnection means to cause said bristles to be retracted into said housing;

said bristle support means being connected to said bristles by a living hinge for permitting relative movement of said bristles with respect to said bristle support means when said bristles are extended and retracted.

* * * * *

UNITED STATES PATENT AND TRADEMARK OFFICE

CERTIFICATE OF CORRECTION

PATENT NO. : 4,987,633

DATED : January 29, 1991

INVENTOR(S) : William R. Heneveld

It is certified that error appears in the above-identified patent and that said Letters Patent is hereby corrected as shown below:

Column 1, line 8;
After "Handle" (1st occurrence) insert --.--;

Column 1, line 23;
After "feature" insert --.--;

Column 3, line 28;
After "bristles" insert --.--;

Column 4, line 36;
"slots 2$" should be --slots 25--;

Column 5, line 57;
After "brushes" insert --.--;

Column 5, line 62;
After "stored" insert --.--.

Signed and Sealed this

Twenty-second Day of September, 1992

*Attest:*

DOUGLAS B. COMER

*Attesting Officer*

*Acting Commissioner of Patents and Trademarks*